United States Patent [19]

Pedersen et al.

[11] Patent Number: 4,984,562

[45] Date of Patent: Jan. 15, 1991

[54] SMOKE CHAMBER FOR FIREPLACE

[75] Inventors: Gunnar Pedersen, Bjergvej 75, DK-7280 Sonder Felding; Flemming Norgard, Haderup, both of Denmark

[73] Assignee: Gunnar Pedersen, Haderup, Denmark

[21] Appl. No.: 389,372

[22] Filed: Aug. 3, 1989

[30] Foreign Application Priority Data

Aug. 5, 1988 [DK] Denmark ..... 63-4384

[51] Int. Cl.[5] ..... F24B 1/18

[52] U.S. Cl. ..... 126/500; 52/21; 52/593; 52/594; 52/595

[58] Field of Search ..... 126/500; 98/58; 52/20, 52/21, 593-595

[56] References Cited

U.S. PATENT DOCUMENTS

| | | | |
|---|---|---|---|
| 926,910 | 7/1909 | Taylor | 126/500 |
| 945,596 | 1/1910 | Prendergast | 52/20 |
| 945,597 | 1/1910 | Prendergast | 52/20 |
| 1,069,944 | 8/1913 | Haggard | 126/500 |
| 1,758,459 | 5/1930 | Mooney | 126/500 |
| 2,473,018 | 6/1949 | Edwards | 52/593 |
| 4,478,208 | 10/1984 | Pitha | 126/500 |
| 4,805,591 | 2/1989 | Pitha | 126/500 |

*Primary Examiner*—Carroll B. Dority

*Attorney, Agent, or Firm*—Finnegan, Henderson, Farabow, Garrett & Dunner

[57] ABSTRACT

A smoke chamber for a fireplace comprising both inclined (23, 24, 27, 28) and vertical (21, 22, 25, 26) supporting elements, each element having abutment surfaces (51) and supporting surfaces (34, 44) of such shape that a signficant part of the load on the inclined elements is converted into a substantially vertical load on the vertical elements. The element built smoke chamber mounted on a burning chamber is immediately upon positioning capable of supporting a heavy brick chimney.

12 Claims, 4 Drawing Sheets

SMOKE CHAMBER FOR FIREPLACE

The present invention relates to a smoke chamber for a fireplace, in particular to a smoke chamber for an element built fireplace, e.g. an open fireplace.

It is known to build an open fireplace from building elements. In order to prevent the side walls of such a fireplace from skidding due to the load imparted on-the fireplace by the chimney, use is e.g. made of a transverse steel reinforcement which is either bolted or welded together. Building and assembling of an open fireplace may thus take several days, which besides expenses for materials entails heavy expenses for workmen. Furthermore, it takes several days for the fireplace to cure enough for the chimney to be mounted on top of it.

Element built open fireplaces also having element built smoke chambers are known, the elements typically being compact and rectangular with an internal smoke hole. Such open fireplaces are capable of supporting the chimney, but have, however, the disadvantage that they are very heavy and consequently difficult both to transport and install.

It is the object of the present invention to devise a smoke chamber for an element built fireplace which first of all is easy to transport and moreover easy to assemble without expensive additional equipment and large consumption of working hours. The open fireplace with smoke chamber must also be capable of supporting the weight of a chimney immediately upon assembling. Furthermore, it is desirable to obtain a reduction in expenses for materials.

The object is achieved in that the smoke chamber is constructed as stated in the characterizing portion of claim 1.

By this construction the pressure from the chimney, which is transferred through the inclined surfaces, may be converted into vertical and horizontal components, respectively, by abutment against the respective supporting surfaces, the horizontal components being converted into inner stresses in the vertical elements. Thus, the risk of the element built smoke chamber, which is positioned on top of a possibly also element built burning chamber, collapsing has been eliminated even if a chimney is mounted on top of the smoke chamber, irrespective of the chimney being a heavy brick chimney.

It is a further advantage of the element built open fireplace that the elements are essentially plane, which is advantageous during transportation as they take up less space and are more easy to pack.

Figure 1:
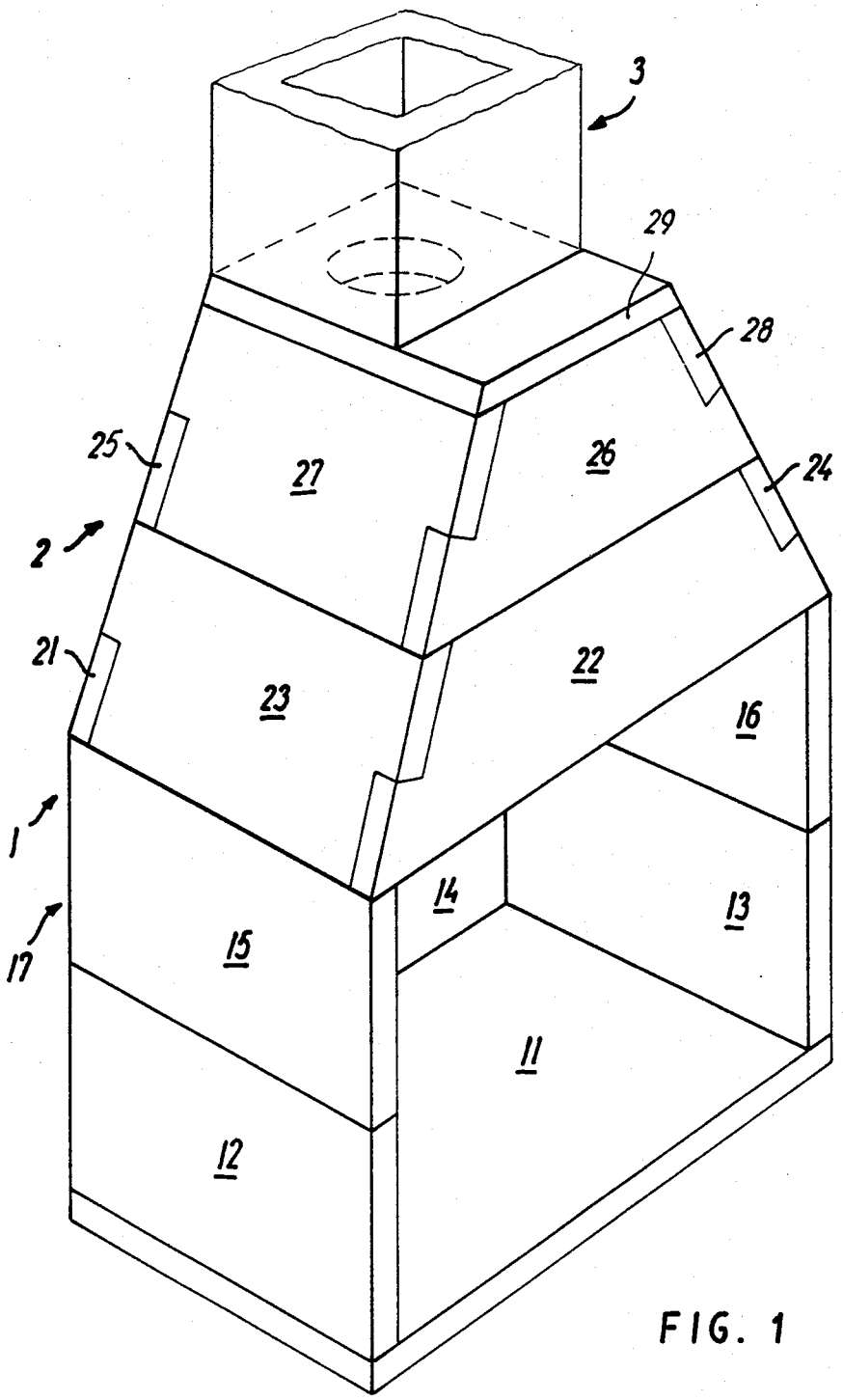
Figure 2:
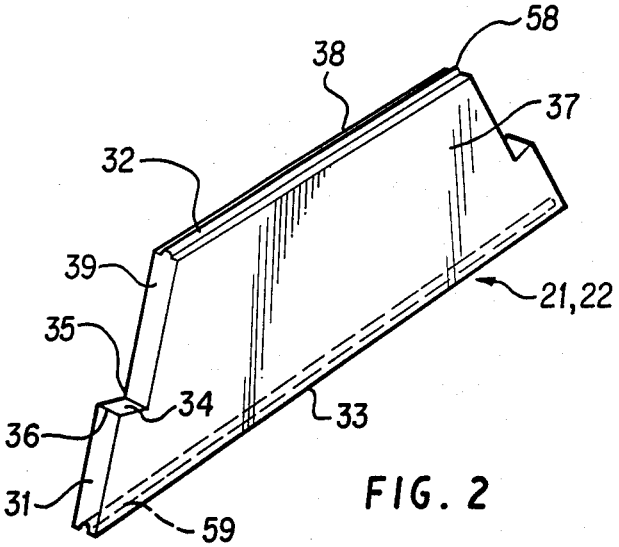
Figure 3:
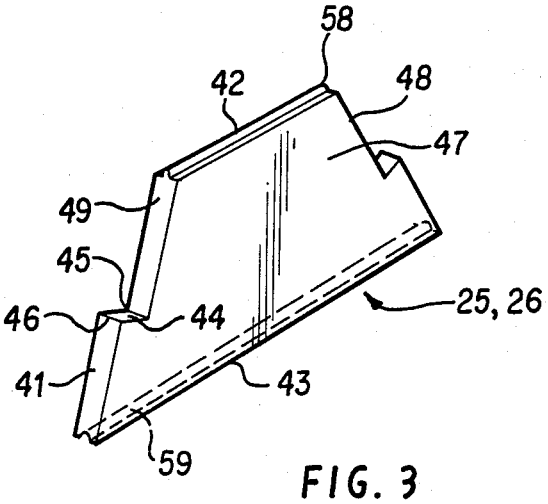
Figure 4:
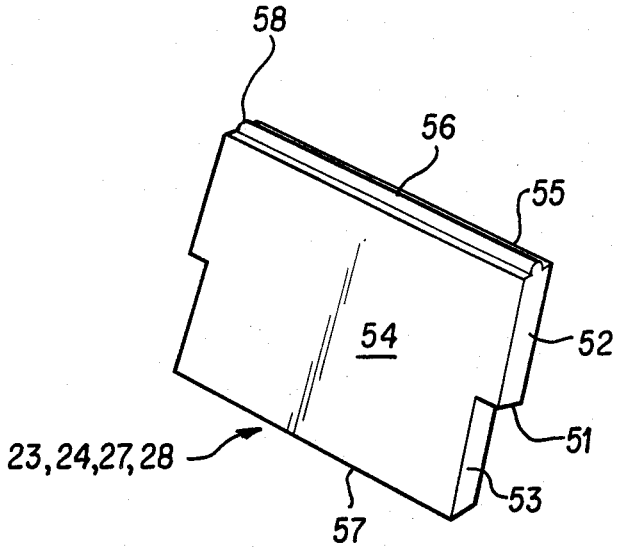
Figure 5:
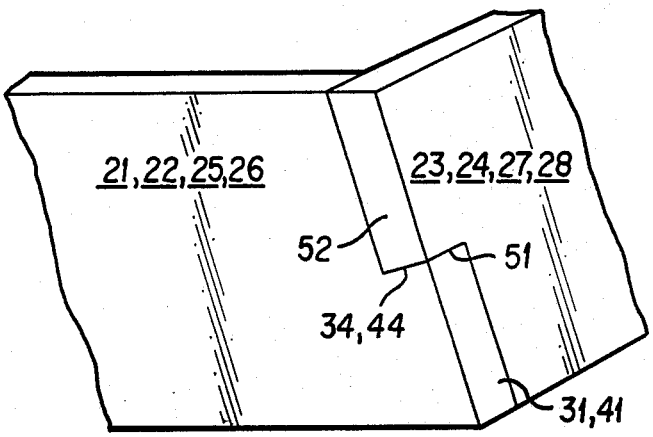
Figure 6:
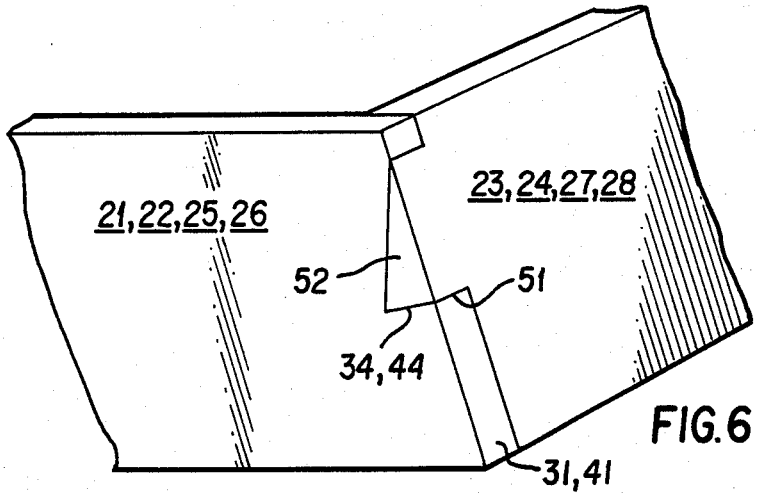
Figure 7:
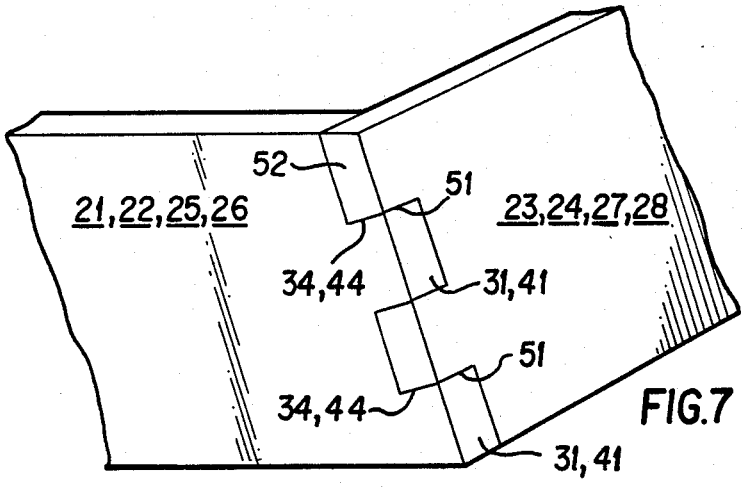

In the following the invention is explained in more detail, reference being made to the drawing in which FIG. 1 shows a perspective view of a smoke chamber according to the invention mounted on a burning chamber and with indication of the chimney pipe, FIGS. 2 and 3 show a vertical element according to the invention FIG. 4 shows an inclined element according to the invention, FIG. 5 shows a preferred embodiment of the engagement between a vertical and an inclined element according to the invention, FIGS. 6 and 7 show alternative embodiments of the engagement between an inclined and a vertical element according to the invention.

FIG. 1 shows an open fireplace consisting of burning chamber 1, a smoke chamber 2, and a chimney 3. The burning chamber comprises a base plate 11, two gables 12, 15 and 13, 16 and a rear wall 14, 17. When mounted together as shown in FIG. 1 these parts form a plane U-shaped area. This area constitutes the foundation of the smoke chamber 2.

An element 21 (shown in FIG. 2) is placed on the area defining the smoke chamber foundation as an extension of the rear wall 17, so that the element 21 forms a plane transition outwardly to the element 17. A second element 22 being identical with the element 21 is positioned so as to rest on the front parts of the gables 15, 16 of the burning chamber, in such a way that it also forms a plane transition to the elements 15 and 16.

Then two elements 23 and 24 (shown in FIG. 4) are mounted as shown in FIG. 1. These two elements 23, 24 rest on abutment surfaces on the elements 21 and 22. The pressure deriving from a chimney 3 is divided into a horizontal and a vertical component, which in case of the latter component essentially is converted into a vertical pressure acting on the elements 21 and 22. The horizontal pressure component is transferred to the elements 21 and 22 and imposes an inner tensile stress on these elements. Hereby the open fireplace is prevented from skidding.

The second layer of the smoke chamber is positioned in a similar way with a rear wall 25 and a front wall 26 (shown in FIG. 3), and it is ensured that the transition outwardly to the underlying elements is plane. Now two elements 27 and 28 are positioned, these elements in the preferred embodiment being identical with the elements 23 and 24. The elements 27 and 28 transform the inclined forces into an essentially vertically acting force on the elements 25 and 26, in the same way as in the underlying layer.

Finally, a top plade 29 is positioned. It is possible immediately to proceed with the mounting of the chimney 3, as the individual elements are in mutual engagement and consequently capable of supporting themselves and the chimney 3.

FIG. 2 shows one of the essentially vertical elements 21 and 22 at the bottom of the smoke chamber according to the invention. Each of the elements 21, 22 comprises two essentially horizontal surfaces 32, 33 constituting contact surface to the overlying layer and base line towards the burning chamber, respectively. Two large surfaces 37 and 38 constitute the inner and outer wall surfaces, respectively, of the smoke chamber. A side edge surface 31 imparts pyramide-shape to the smoke chamber by its inclination relative to the vertical position. A supporting surface 34 ensuring pressure transfer from the inclined elements to the vertical elements has an inner edge 35 and an outer edge 36. In order to prevent skidding, the edge 36 is at a higher level than the edge 35, optionally at the same level. The called for level difference depends upon the inclination of the side edge surface 31.

FIG. 3 shows one of the essentially vertical elements 25 and 26 at the top of the smoke chamber. Out of the essentially horizontal surfaces the surface 42 forms abutment surface against the top plate 29, while a surface 43 forms abutment surface against the surface 32 of the element 21, 22. Besides that, the side edge surfaces and the surfaces 41, 44, 45, 46, 49, 47 and 48 have the same designation, function and inclination as the corresponding side edge surfaces and surfaces 31, 34, 35, 36, 39, 37 and 38 in FIG. 2. The elements 25, 26 differ from the elements 21, 22 in having a shorter base line so that the side edge surface 41 forms a smooth transition to the gable surface 54.

FIG. 4 shows an inclined element 23, 24, 27 and 28 constituting the gables of the smoke chamber 2. The surface 54 constitutes the gable surface proper, while a surface 55 constitutes part of the interior of the smoke chamber. An abutment surface 51 transfers inclined pressure to the supporting surfaces 34 and 44, respectively. Edge surfaces 56 and 57 form an angle with the surface 54 so that the edge surfaces 56 and 57 are horizontal when the inclined element is positioned on the vertical elements, 21, 22 or 25, 26, respectively. By this means there is obtained a tight fitting connection with the top plate 29 and the burning chamber 1, respectively.

There exist several alternative embodiments of the engagement between an inclined and a vertical element. In the preferred embodiment use is made of a combination of the two elements. Any suitable kind of engagement between the two elements, e.g. countersinking or journalling, could have been used.

It is essential to the invention that the vertical elements have one or more abutment surfaces on which the inclined elements essentially rest. Such an abutment surface must have an inclination so that the inclined element must be lifted in order to pass out of engagement. Consequently, the open fireplace locks itself as it is assembled. This is done without use of binding agents.

In the preferred embodiment shown in FIG. 5, the vertical and the inclined element are combined by an abutment surface which is vertical relative to the inclined side edge surfaces.

In an alternative embodiment shown in FIG. 6 the vertical element is provided with a wedge-shaped recess having an abutment surface which is substantially horizontal, however, still highest at the side edge surface. The inclined element has a protrusion corresponding to the wedge-shaped recess.

FIG. 7 shows another embodiment with several abutment surfaces between the vertical and the inclined element.

An embodiment is contemplated in which the inclined and the vertical elements have no cutouts. The inclined abutment surfaces may instead be provided with holes to receive one or more dowels which then serve as connecting means. Hereby the pressure coming from above is transferred from the inclined to the vertical elements.

The material used for the open fireplace elements may advantageously be some kind of light-weight concrete, e.g. pumice admixed with concrete. These materials are characterized by their fine insulation properties. As the material is significantly lighter than concrete, it is possible to produce larger elements and consequently obtain larger surfaces. This means that a smaller number of elements is required for building the open fireplace. This again means that the finished open fireplace has less joints and consequently increased tightness. The larger elements provide improved precision when assembling the fireplace because of the reduced risk of inaccurate assembling.

Advantageously, a kind of joint filler may be used between the elements, thus providing an improved abutment surface. This, however, is not necessary as the force of gravity provides the requisite pressure on the elements so as to hold the elements so closely together that there will only be few crevices. The crevices occuring when not using sealing material are quickly closed by soot when the open fireplace is put into use. As a result, they give no rise to false draught, soot condensation etc.

In an alternative embodiment the boundary surfaces 32, 33, 42, 43, 56 between the individual layers of the smoke chamber, the burning chamber and the chimney 3 are joined by tongue and groove joints 58 and 59, whereby the individual elements are controlled in position during assembling.

We claim:

1. A smoke chamber for a fireplace and adapted to convert the load from a superimposed chimney having a horizontal cross section different from that of an underlying burning chamber to an essentially vertical load on the burning chamber, which smoke chamber comprises a pair of opposing inclined walls joined to a pair of opposing substantially vertical walls wherein (a) said vertical walls comprise opposing substantially vertical supporting elements each having (1) opposing inclined side edge surfaces extending upwardly and inwardly, each having a recess therein providing a support surface thereon and (2) opposing substantially horizontal top and bottom edge surfaces;

(b) said inclined walls comprise opposing inclined supporting elements each having (1) opposing substantially horizontal top and bottom edge surfaces and (2) opposing side edge surfaces, each having a recess providing an abuttment surface thereon which abuts against a corresponding support surface;

(c) so that said smoke chamber acts to transfer the weight of said chimney to the walls of said burning chambers.

2. A fireplace comprising:

(a) a burning chamber having a first horizontal cross section formed by generally vertical walls;

(b) a smoke chamber superimposed on said burning chamber;

a chimney superimposed on said smoke chamber and having a second horizontal cross section different from said first cross section;

said smoke chamber being adapted to transfer the horizontal and vertical components of the pressure thereon resulting from the weight of said chimney to a vertical pressure on said walls of said burning chamber and being defined by a pair of opposing inclined walls joined to a pair of opposing substantially vertical walls; wherein (e) said vertical walls comprise opposing substantially vertical supporting elements each having (1) opposing inclined side edge surfaces extending upwardly and inwardly, each having a recess therein providing a support surface thereon and, (2) opposing substantially horizontal top and bottom edge surfaces;

(a) said inclined walls comprise opposing inclined supporting elements each having (1) opposing substantially horizontal top and bottom edge surfaces and (2) opposing side edge surfaces, each having a recess providing an abuttment surface thereon which abuts against a corresponding surface;

(g) so that said smoke chamber acts to transfer the weight of said chimney to the walls of said burning chambers.

3. The fireplace of claim 2, wherein said vertical supporting elements have a generally trapezoidal form, and said support surfaces face upwardly and each have an outer portion adjacent its corresponding side edge surface and an inner portion inwardly remote therefrom and wherein each of said support surfaces is inclined downwardly from said outer portion toward said inner portion.

4. The fireplace of claim 3, wherein said support surfaces each intersects its corresponding inclined side edge surface at a right angle.

5. The smoke chamber of claim 1, wherein said vertical supporting elements have a generally trapezoidal form, said support surfaces facing upwardly and each has an outer portion adjacent its corresponding side edge surface and an inner portion inwardly remote therefrom and wherein each of said support surfaces is inclined downwardly from its outer portion toward its inner portion.

6. The smoke chamber of claim 5 wherein said support surfaces each intersects its corresponding inclined side edge surface at a right angle.

7. The fireplace of claim 2, wherein said supporting elements are made of light-weight concrete.

8. The smoke chamber of claim 1, wherein said supporting elements are made of light-weight concrete.

9. The fireplace of claim 2, wherein said supporting elements are joined by a sealing and binding agent.

10. The smoke chamber of claim 1, wherein said supporting elements are joined by a sealing and binding agent.

11. The fireplace of claim 2, wherein said horizontal edge surfaces are provided with tongue and groove.

12. The smoke chamber of claim 1, wherein said horizontal edge surfaces are provided with tongue and groove.

* * * * *

UNITED STATES PATENT AND TRADEMARK OFFICE

CERTIFICATE OF CORRECTION

PATENT NO. : 4,984,562

DATED : January 15, 1991

INVENTOR(S) : Gunnar Pedersen and Flemming Norgard

It is certified that error appears in the above-identified patent and that said Letters Patent is hereby corrected as shown below:

Abstract, line 5, change "signficant" to --significant--.

Claim 2, column 4, line 41, insert --(c)-- before "a".

Claim 2, column 4, line 44, insert --(d)-- before "said".

Claim 2, column 4, line 58, change "(a)" to --(f)--.

Claim 2, column 4, line 63, insert --support-- before "surface".

Signed and Sealed this

Ninth Day of June, 1992

*Attest:*

*Attesting Officer*

DOUGLAS B. COMER

*Acting Commissioner of Patents and Trademarks*